United States Patent [19]

Wiseman

[11] 4,148,393

[45] Apr. 10, 1979

[54] SENSING DEVICE AND METHOD

[76] Inventor: Raymond L. Wiseman, 1550 S. Macon St., Aurora, Colo. 80012

[21] Appl. No.: 801,153

[22] Filed: May 27, 1977

[51] Int. Cl.[2] ..... G06M 7/00

[52] U.S. Cl. ..... 198/503; 235/98 B

[58] Field of Search ..... 198/503, 502, 444, 857; 93/93 C; 235/92 PK, 92 SB, 98 R, 98 A, 98 B, 98 C

[56] References Cited

U.S. PATENT DOCUMENTS

| | | | |
|---|---|---|---|
| 3,027,075 | 3/1962 | Howdle et al. | 198/503 X |
| 3,202,779 | 8/1965 | Call | 235/98 R X |
| 3,219,829 | 11/1965 | Reist | 198/503 X |
| 3,286,921 | 11/1966 | Hyer et al. | 235/98 R |
| 3,702,925 | 11/1972 | Anderson et al. | 235/98 B X |

*Primary Examiner*—Robert B. Reeves
*Assistant Examiner*—James L. Rowland
*Attorney, Agent, or Firm*—Fay & Sharpe

[57] ABSTRACT

A sensing device for sensing individual articles such as newspapers, magazines and the like in a stream of such articles flowing along a predetermined work path. The device and method utilize a rotatably mounted polygonal sensing member having an outer peripheral surface comprised of a plurality of distinct alternating sides and corners. The sensing member is disposed at a sensing station and mounted so that the leading edge of each consecutive article in the stream engages consecutive corner and side areas of the sensing member thereby causing incremental rotation thereof. An activating vane is disposed in operative engagement with the sensing member so that during such incremental rotation, the vane is moved between non-activating and activating positions. A transducer is disposed in operative association with the activating vane such that movement of the vane between the activating and non-activating position brings the vane toward and away from a close spaced relationship therewith to cause cyclical energization and de-energization thereof. The pulses obtained from the transducer may then be employed to operate attendant equipment including, for example, a counter for maintaining an accurate count of the articles passing along the work path.

17 Claims, 7 Drawing Figures

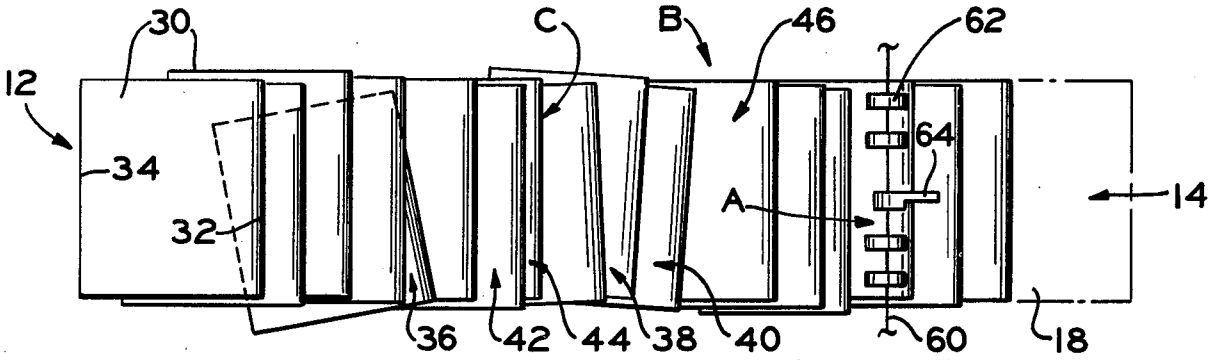
FIG. 1
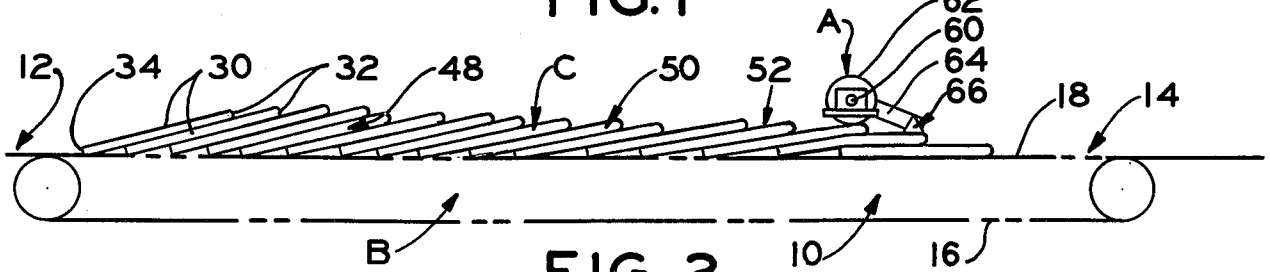
FIG. 2
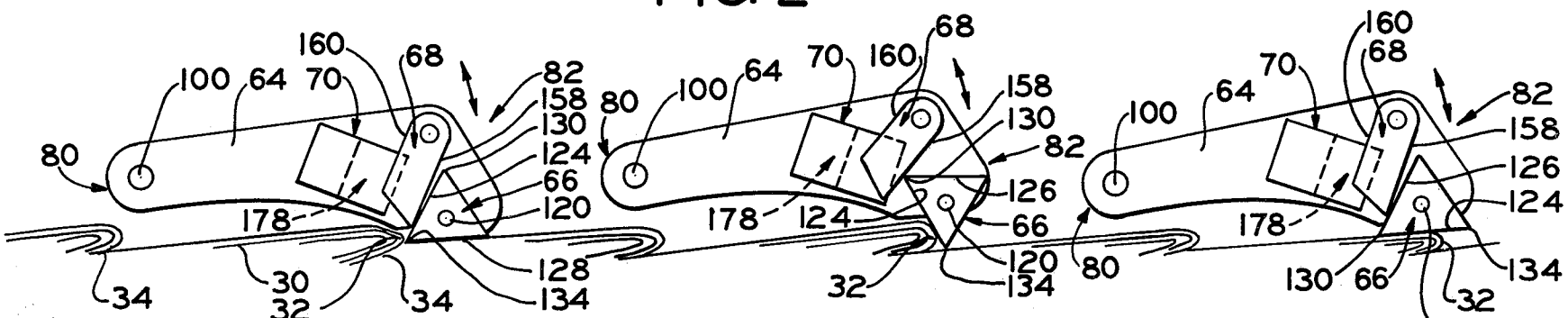
FIG. 7
FIG. 6
FIG. 5

SENSING DEVICE AND METHOD

BACKGROUND OF THE INVENTION

This invention pertains to the art of sensing devices and more particularly to sensing devices for sensing individual articles passing along a work path.

The invention is particularly applicable to a sensing device for sensing individual newspapers, magazines and the like passing in a continuous stream along a processing line in an overlapped relationship relative to each other and will be described with particular reference thereto. However, it will be readily appreciated by those skilled in the art that the invention has far broader applications and may be advantageously employed in many other environments for sensing articles wherein there is relative movement between the sensing device and the articles themselves.

Printing presses, bindery equipment and the like most commonly deliver newspapers, magazines and other printed articles in a continuous stream with one of the edges of each article overlapping a portion of the next adjacent article. Typically, in this overlapped condition, the leading edges of adjacent articles are pitched or spaced apart from each other. Depending on the size and type of article involved, this spacing may vary from as much as several inches to as little as less than one inch. In these continuous streams of articles, the articles are not always precisely located or lapped relative to each other such that there are many misaligned articles and variations in the spacing between consecutive articles.

Sensing units are utilized to detect the individual articles as they pass along the continuous stream in order to count the articles and control attendant stacking, bundling and binding machinery. Heretofore, the misaligned articles have made prior sensing devices unreliable when combined with high speeds at which modern printing lines operate. Modern newspaper printing presses can deliver over 20 papers per second and it is common, for example, to deliver 20 papers per second at an average of 3 inches apart. This requires a stream velocity of 60 inches per second or 300 feet per minute. When individual articles are misplaced to be 1 inch apart in a stream moving at 60 inches per second, the resultant instantaneous rate presented to a sensor is 60 articles per second. Thus, it is necessary to provide for quick acting and accurate sensing means in order to maintain an accurate count of the articles flowing along the stream.

Misplacing and misalignment of articles in the stream is quite frequent. Such misplacing and misalignment are not only caused by the attendant preceeding machinery, but are also caused by persons along the line removing one or more of the articles for inspection or the like and then reinserting them into the stream. Uneven spacing between the articles causes variations in stream thickness since more closely spaced lapped articles results in more articles being overlapped in that section. In addition to variations caused by spacing, the thickness varies with that of the individual articles themselves. For example, the number of pages in a newspaper varies from day to day and will, therefore, affect the average stream thickness or height. The leading surface or edge of newspapers being delivered along the stream is usually the folded edge and the folds may be tight or relatively loose and bulbuous. Sections within a newspaper may be improperly collated and may also contain wrinkles, holes and other defects. All of the above specifically mentioned anomalies render it difficult to sense and count newspapers, magazines and other articles accurately.

Elimination of problems caused by inaccurate sensing of such articles has been the focus of some substantial attention by both publishing groups and engineers. Far more papers and magazines are printed than can normally be accounted for and some packages of papers or magazines contain too many or too few articles. Moreover, stackers and other attendant article handling equipment are caused to malfunction. The combination of variables existing in a stream of papers has resulted in many prior efforts to perfect a sensing device and method which would accommodate the specific variables discussed above and accurately sense individual articles. These prior efforts have culminated in many different types and styles of sensing devices and methods which have met with varying degrees of success. Some printing lines employ more than one type of sensing device depending on the specifics of the stream conditions and/or technical adjustments are made on the sensing devices on a day to day basis depending on the nature of those articles which will comprise the stream itself. The lack of an accurate and reliable article count has come to be simply tolerated rather than accepted since no sensing device and method has yet been developed to overcome all the above problems encountered in such processing lines.

Substantially all of the sensing devices and methods presently in use in the preferred environment for the subject invention depend on physical contact with the articles in the stream. For example, some prior devices have utilized sensing wheels which are placed in contact with the article stream for rotation thereby. The sensing wheels, in turn, cause periodic activation of a transducer as they are rotated in order to maintain a running count of the individual stream articles. However, these prior constructions have had several drawbacks from structural and operational points of view. First, many have been rather complicated in design and, therefore, subject to maintenance problems. The sensing wheels of these prior devices have been such that they were inherently subject to yielding "false" readings or counts due to variations in the stream configuration. To counteract the potential for such "false" readings or counts, it has been necessary to place a biasing force either on or adjacent the sensing wheels to prevent counter rotation thereof. This biasing means made it more difficult and required more force to rotate the sensing wheels in the desired direction to achieve a stream count. Thus, these prior devices require a sensing wheel indexing force which is higher than that which can be provided by small or light papers flowing along an article stream. Still further, the basic geometric configurations of prior sensing wheels have not taken optimum design criteria into full consideration.

All prior efforts to develop non-contacting types have proved unsuccessful and provided unacceptable results. Photo, ultrasonic, fluidic and laser are some of the energy forms utilized in prior attempts at non-contact sensing. Failure of these non-contacting devices and methods has been due to variables in color, conformation, shape, positioning, spacing and the like which are all intrinsic in a stream of newspapers, magazines and like articles.

The present invention contemplates a new and improved method and apparatus which overcome all of the above referred to problems and others and provides a new sensing device and method which are simple, economical, accurate, operable at a high rate of stream speed and which are readily adaptable for use in sensing a wide variety of articles moving along a work path in many other environments.

BRIEF DESCRIPTION OF THE PRESENT INVENTION

In accordance with the present invention, there is provided a sensing device for sensing individual ones of a plurality of articles continuously flowing along a predetermined work path from a first toward a second position therealong. The device includes a sensing device body having a sensing end disposed in operable association with the work path. A polygonal sensing member is rotatably mounted at generally the central axis thereof to the body adjacent the body sensing end. The outer peripheral surface of the sensing member is comprised of a plurality of alternating distinct sides and corners with the sensing member adapted for incremental rotation about its central axis in response to engagement of the consecutive side and corner areas thereof by the leading edges of articles as they are moved therepast along the workpath. An activating means is operably associated with the sensing member and incrementally movable between activating and non-activating positions in response to incremental rotation of the sensing member. A transducer means is operably disposed relative to the activating means and selectively movable between energized and non-energized conditions in response to movement of the activating means between the activating and non-activating positions.

In accordance with another aspect of the present invention, the activating means is disposed in operative engagement with the outer peripheral surface of the sensing member. The activating means is moved from one of the activating and non-activating positions to the other of the positions as engagement thereof by the sensing member moves from one of the sensing member sides toward the adjacent corner and is moved from the other position back to the one position as engagement thereof by the sensing member moves from the adjacent corner to the next adjacent side during incremental rotation of the sensing member.

In accordance with another aspect of the present invention, the activating means comprises an activating vane which is continuously biased toward engagement with the sensing member. The vane is in a non-activating position when in engagement with a side of the sensing member and is moved toward the activating position as it is engaged by a corner of the sensing member.

In accordance with yet another aspect of the present invention, the sensing device body includes means for mounting the device so that at least the sensing member may be selectively moved toward and away from the work path in response to varying thicknesses in a stream of articles passing therealong.

In accordance with still another aspect of the present invention, there is provided a method for sensing individual articles transported along a work path from a first position to a second position. The method comprises the steps of:

(a) placing a rotatably mounted polygonal sensing member having alternating sides and corner areas disposed about the outer peripheral surface thereof in a close spaced relationship with the work path;

(b) allowing consecutive articles flowing along the work path to engage adjacent side and corner areas of the sensing member to cause incremental rotation thereof;

(c) moving an activating member between activating and non-activating positions in response to each increment of sensing member rotation; and, (d) causing a transducer to be moved between energized and non-energized conditions in response to movement of the activating member between its activating and non-activating positions.

In accordance with a still further aspect of the present invention, the step of moving comprises placing the activating means in continuous operative engagement with the sensing member and causing the activating means to be moved from a non-activating to an activating position as operative engagement thereof by the sensing member moves from one of the sides toward the adjacent corner and to then be moved from the activating position back to the non-activating position as engagement thereof by the sensing member moves from the adjacent corner toward the next adjacent side during incremental rotation of the sensing member.

The principal object of the present invention is the provision of a new sensing device and method for sensing individual articles in a stream of such articles flowing along a work path.

Another object of the present invention is the provision of a new sensing device and method which are simple in design and operation.

A still further object of the present invention is the provision of a new sensing device and method which are extremely responsive to variations in the flow of articles along the work path.

Still another object of the present invention is the provision of a new sensing device and method which are readily adapted to use in any number of environments where it is desired to sense individual articles flowing from one position to another along a work path.

BRIEF DESCRIPTION OF THE DRAWINGS

The invention may take physical form in certain parts and arrangements of parts, a preferred embodiment of which will be described in detail in this specification and illustrated in the accompanying drawings which form a part hereof and wherein:

FIG. 1 is a plan view of a newspaper processing line showing the device of the subject invention installed in an operative relationship adjacent thereto with certain of the newspapers along the line being misplaced or out of alignment;

FIG. 2 is a side elevational view of the line shown in FIG. 1;

FIG. 5 is a generally schematic view for showing operation of the subject sensing device and method in a newspaper printing line as a newspaper approaches the device for counting purposes;

FIG. 6 is a view similar to FIG. 5 but showing the newspaper in engagement with the sensing member and rotating the sensing member about its pivot mounting; and, FIG. 7 is a view similar to FIG. 5 but showing the newspaper after it has been counted and the sensing member moved to a sensing condition for counting the next adjacent newspaper in the line.

DESCRIPTION OF THE PREFERRED EMBODIMENT

Figure 4:
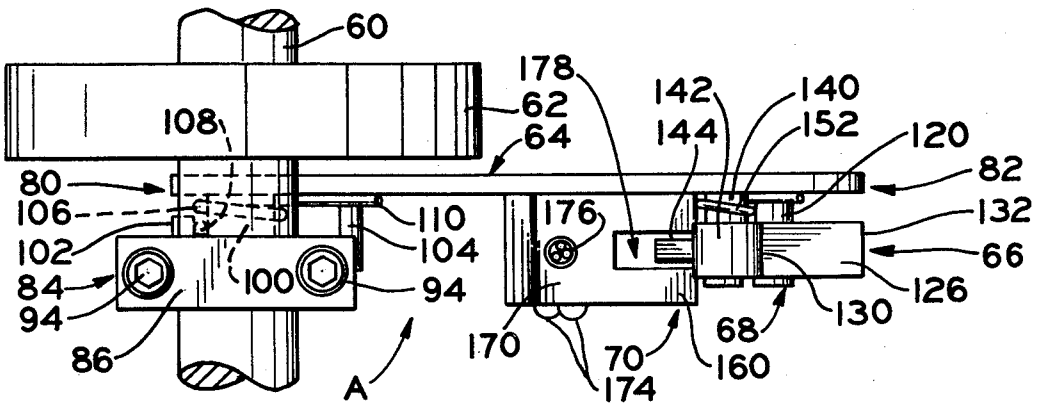
FIG. 4 is a plan view of the device shown in FIG. 3.

Referring now to the drawings wherein the showings are for purposes of illustrating the preferred embodiment of the invention only and not for purposes of limiting same, the FIGURES show a sensing device A mounted in operative relationship adjacent a processing line B which defines a work path and which moves a stream of articles C such as newspapers, magazines and the like from one position to another. The present invention will hereinafter be described with particular reference to a newspaper processing line, although it should be appreciated that the invention has far broader applications and is equally adaptable to other printing line environments as well as environments outside of the printing industry.

More particularly and with reference to FIGS. 1 and 2, processing line B is comprised of a conveyor system generally designated 10 having a first end 12 and a second end 14. A continuous belt or other article supporting arrangement 16 is provided to continuously move a stream of articles C from first end 12 to second end 14 along the upper surface 18 of the belt or other supporting arrangement. Further specifics of processing line B are not shown or described in detail inasmuch as they do not in any way form a part of the present invention and may vary from installation to installation. In a newspaper printing line, however, conveyor system 10 is normally positioned adjacent the end of the line to receive the completed newspapers at first end 12 and convey them toward second end 14 and the appropriate attendant devices for properly stacking and bundling the newspapers.

The individual newspapers in stream C are generally designated 30 in FIGS. 1 and 2. Each paper has a leading edge 32 and a trailing edge 34. Conventionally, the leading edge is defined by the folded area running transversely across the newspaper at generally the midpoint thereof. Preferably, newspapers 30 which comprise stream C are disposed so that the leading edges are generally normal to the longitudinal axis of processing line B.

However, and due to the nature of the paper processing machinery itself as well as inspectors and other persons removing and then replacing papers into stream C, some of the papers will be misaligned from their preferred placement. Such misaligned papers are shown in FIG. 1 and individually designated by numerals 36,38 and 40. Moreover, the spacing or pitch between adjacent papers will sometimes be varied due to the same reasons and individual papers having different spacings between their lead edges are exemplified by those individually designated 42,44 and 46 in FIG. 1. The result of the misalignment as exemplified by individual newspapers 36,38 and 40 as well as unequal spacing as exemplified by individual papers 42,44 and 46 is a variation in the overall height of the stream as it flows along processing line B. In this regard, attention is invited to FIG. 2 and the quite readily apparent difference in height of individual newspapers 48,50 and 52 therein.

FIGS. 1 and 2 show a typical newspaper processing conveyor or line as well as the various anomalies which can and do occur in a stream of articles flowing along a work path between spaced apart first and second positions. The various anomalies are primarily what has caused inaccurate sensing and counting when using prior known sensing devices and methods. The present sensing device and method as will be described in detail hereinafter are deemed particularly suited for and successful in overcoming the prior sensing problems discussed above in detail.

Sensing device A is mounted above processing line B intermediate ends 12 and 14 as generally schematically shown in FIGS. 1 and 2. As will also be noted there, sensing device A is mounted on a shaft or axle schematically shown and generally designated 60 with the shaft or axle including a plurality of spaced apart rollers or other conventional paper engaging members 62. Shaft or axle 60 is conveniently mounted at its opposite ends by means (not shown) so that the shaft or axle is spaced above upper surface 18 of conveyor system 10. The appropriate mounting means may and will be varied between specific processing line B installations. In FIG. 1, sensing device A is located on shaft or axle 60 such that it is generally centrally located relative to the side edges of conveyor system 10.

Figure 3:
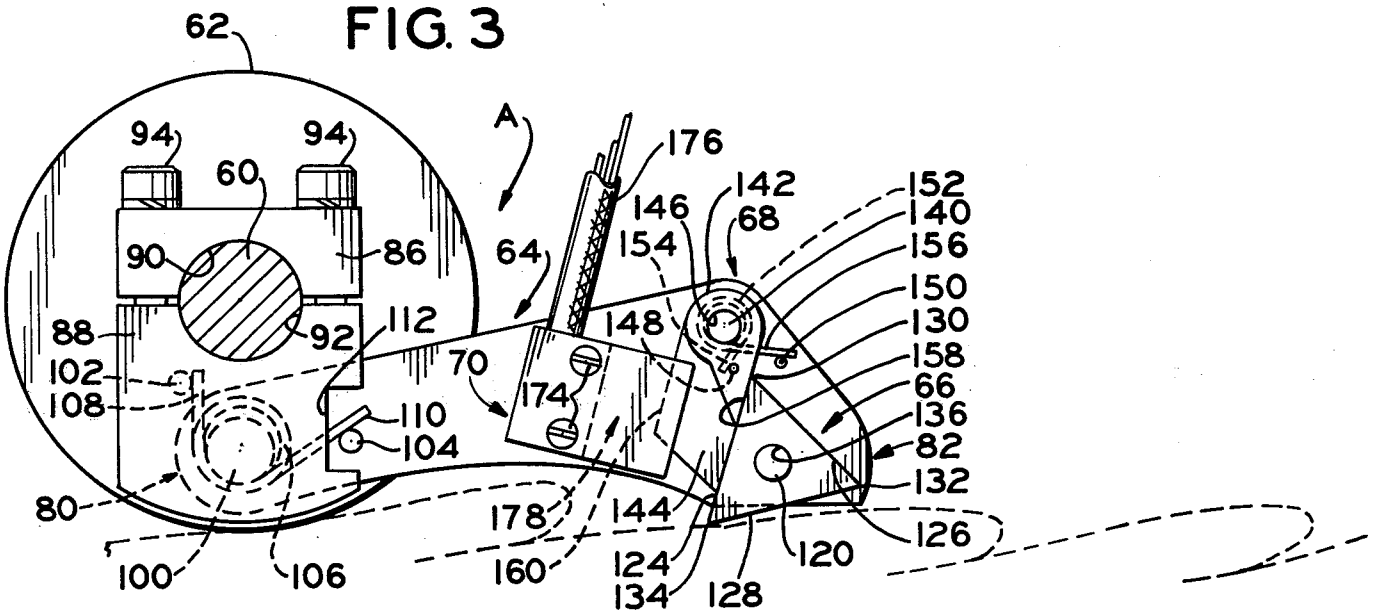
FIG. 3 is a side elevational view of the sensing device itself which incorporates the concepts of the subject invention therein.

With particular reference to FIGS. 3 and 4, sensing device A has been enlarged from that generally shown schematically in FIGS. 1 and 2 so that the more specific structural and operational details thereof may be more readily appreciated. The sensing device is basically comprised of a sensing device body generally designated 64, a sensing member generally designated 66, activating means generally designated 68 and a transducer generally designated 70.

Sensing device body 64 includes a mounting end 80 disposed adjacent shaft or axle 60 and a sensing end 82 spaced therefrom. A conventional split block arrangement 84 is employed to mount sensing device A to shaft 60. This split block arrangement is comprised of an upper portion 86 and a lower portion 88 including arcuate generally semicircular receiving areas 90,92 respectively, for close receipt over a portion of the shaft. Mechanical fasteners 94 passing through upper portion into threaded engagement with the lower portion are advantageously employed without in any way departing from the overall intent or scope of the present invention.

Extending outwardly from lower portion 88 is a pivot mounting pin generally designated 100 for pivotally receiving sensing device body 64 thereon adjacent mounting end 80 by means of an opening passing therethrough. The dimensional relationship between the opening and pivot mounting pin 100 is such to allow pivotal movement of the sensing device body about pin 100 within defined limits for reasons which will become more readily apparent hereinafter. The sensing device body may be retained on the pivot mounting pin by any number of convenient means.

Also extending outwardly from lower split block portion 88 from the same side thereof as pivot mounting pin 100 and toward sensing device body 64 in a first retaining pin 102. Extending outwardly from sensing device body 64 toward split block lower portion 88 is a second retaining pin 104. A torsional spring 106 is received around pivot mounting pin 100 with end 108 thereof received against retaining pin 102 and end 110 thereof received against retaining pin 104. The result of this spring installation is that end 110 acting against retaining pin 104 continuously urges sensing device body 64 arcuately toward upper surface 18 of conveyor system 10. The forward edge of split block lower portion 88 includes an inwardly extending groove 112 therethrough and retaining pin 110 is disposed in the sensing device body so as to be received within the confines of this groove. The side edges of the groove act as stops so that arcuate movement of the sensing device body about pivot mounting pin 100 will be through defined upper and lower limits.

A pivot mounting pin 120 extends outwardly from sensing device body 64 adjacent sensing end 82 thereof for pivotally mounting sensing member 66 therein as will be more readily appreciated hereinafter. Sensing member 66 itself comprises a polygonal member having a plurality of alternating distinct sides and corners which comprise the outer peripheral surface thereof. In the preferred embodiment here under discussion, sensing member 66 has a generally equilateral triangular configuration comprised of sides 124,126 and 128 and corners 130,132 and 134. An opening 136 extends through the sensing member between the opposed side faces at generally the central axis thereof. Opening 136 is dimensioned so that the sensing member may be closely and freely received over pivot mounting pin 120 to allow free rotation thereof about its central axis. The sensing member is retained on pivot mounting pin 120 by any number of alternative and convenient means.

In the preferred arrangement here under discussion, sensing member 66 is constructed from a plastic material which has a low coefficient of friction in order that the sensing member may easily slide over articles passing thereby in contact therewith with a minimum of friction being generated. While Nylatron containing molybdenum disulfide is preferred, other plastic materials such as Teflon and the like could also be advantageously employed without in any way departing from the overall intent or scope of the present invention. Moreover, and while a triangular shaped sensing member is preferred, other polygonal configurations having alternating distinct sides and corners could also be advantageously employed. The primary reasons for preferring the triangular configuration is that it provides more favorable torque balance, has a small dynamic energy, requires a low operating force and is able to avoid "false" readings or counts. The triangular configuration also provides a greater "throw" or degree of arcuate movement of the actuating member between the activating and non-activating positions as will hereinafter be more fully described.

A pivot mounting pin 140 extends outwardly from sensing device body 64 in the same direction as and parallel to pivot mounting pin 120. Pin 140 is disposed above and intermediate sensing member 66 and transducer 70. Activating means 68 comprises an elongated activating vane having a mounting portion 142 and a vane portion 144. Mounting portion 142 includes a mounting opening 146 therein adapted to be closely slidably received over pin 140 to permit arcuate vane movement thereabout in response to rotational movement of sensing member 66. A pair of retaining pins 148,150 (FIG. 3) extend outwardly from vane portion 144 and from sensing device body 64, respectively, adjacent pin 140. A torsional spring 152 having opposed ends 154,156 is received over pin 140 between sensing device body 64 and the inner face of activating means 68. The spring is configured and dimensioned so that ends 154,156 engage retaining pins 148,150, respectively. The arrangement of torsional spring 152 acts to bias activating member 68 about pivot mounting pin 140 toward engagement with sensing member 66. Vane portion 144 of the activating member includes a front planar surface 158 adapted to engage the sensing member and a rear planar surface 160 adapted to be moved into and out of a close spaced relationship with transducer 70 in response to incremental rotational movement of the sensing member as will hereinafter be more fully described. Moreover, at least a planar side surface of vane portion 144 includes a metallic segment (not shown) which is selectively brought into the field of transducer 70 to cause energization thereof in a manner which will also be more fully described hereinafter. While this metallic segment may take many forms, a metal foil may be advantageously employed.

Transducer 70 has a transducer body 170 affixed to sensing device body 64 by conventional mechanical fasteners 174. Conventional lead wires 176 extend outwardly from the transducer toward the control system for processing line B as well as other attendant equipment associated therewith for controlling various processing line equipment in response to the number of individual papers 30 flowing along stream C. The transducer includes an elongated slot or groove 178 in the forwardly disposed wall thereof dimensioned to receive at least a portion of activating means vane portion 144 during operation of the sensing device. In the preferred arrangement, and although other specific types of transducer arrangements could be advantageously employed without in any way departing from the intent or scope of the present invention, transducer 70 is of the type which has a sensitive electronic oscillator field at the forward end thereof within groove or slot 178. This field is affected by the metallic segment of the vane portion when the vane is moved to an activating position in response to incremental rotation of the sensing member. The effect of vane portion 144 and the metallic segment when moved to an activating position is to cause a rapid voltage rise between two conductors (not shown) in the transducer. As the vane is then moved back to a non-activating position in response to further incremental rotation of the sensing member, the field effect and voltage change back to their original state. This voltage swing forms a pulse passed through lead wires 176 to control means (not shown) which is useful for counting articles passing along stream C and/or for controlling other attendant paper handling equipment.

In the preferred arrangement hereinabove described and shown in the drawings, sensing device A is mounted above processing line B in a manner such that sensing end 82 of sensing device body 64 extends toward second end 14 of conveyor system 10. Further, sensing device body A is mounted relative to split block 84 so that arcuate movement thereof about pivot mounting pin 100 is in a plane generally normal to the plane of upper surface 18 of conveyor system 10. Sensing member 66 is also mounted relative to sensing body 64 so that rotation thereof about pivot mounting pin 120 is in a plane generally normal to the plane of upper surface 18 and parallel to the plane of arcuate movement for the sensing device body about pin 100.

Attention is now invited to FIGS. 5–7 which show a somewhat schematic view of the subject sensing device and method when placed into practical application on a newspaper processing line. For ease of illustration, split block 84 has been eliminated from these FIGURES and it should be understood that sensing device body 64 is arcuately movable about pin 100 as shown therein.

In FIG. 5, sensing device A is shown with side 128 of the sensing member in contact with one of a plurality of papers 30 which comprise stream C. This FIGURE demonstrates the relative positions of the components just before sensing member 66 is contacted by leading edge 32 of the next newspaper 30 passing thereby. Leading edge 32 of this paper contacts side 124 and corner 134 at generally adjacent the intersection thereof causing the sensing member to be rotated about pivot mounting pin 120 in a direction counterclockwise as viewed in FIG. 5.

With reference to FIG. 6 and as the sensing member is rotated by leading edge 32 engaging side 124 adjacent corner 134, activating member or vane 68 is pivoted about pivot mounting pin 140 overcoming the opposite biasing force of torsional spring member 152 so that the vane is moved from an initial non-activating position as shown in FIGS. 3 and 5 toward a second or activating position as generally shown in FIG. 6. This movement is caused by corner area 130 of the sensing member engaging front planar edge 158 of the actuating vane and thereafter forcing the vane toward transducer 70 into groove or slot 178. In FIG. 6, the vane is shown in a position just past the point of its maximum pivoted movement to the activating position. Just prior to reaching the position shown, the sensitive electronic oscillator field of transducer 70 is affected by the small metallic segment on the planar side surface of vane portion 144 to cause a rapid voltage rise between the pair of conductors in the transducer. As the vane then moves back toward its initial or non-activating position as shown in FIG. 7 so that it is in engagement with side 126, the field effect and voltage of transducer 70 change back to the original state. This voltage swing forms a pulse which may be transmitted from the transducer to means spaced remote therefrom for counting the individual newspapers passing along stream C and/or for activating attendant paper processing equipment.

In the motion of sensing member 66 between that shown in FIGS. 5 and 6, the activating means or vane acts to resist rotation of the sensing member due to the urging of torsional spring 152. Slightly beyond the FIG. 6 position of the sensing member, torsional spring 152 acts to urge continued rotation of the sensing member to the position shown in FIG. 7 in anticipation of and in preparation for engagement by the next newspaper in the stream. Further rotation of the sensing beyond that point, however, is prevented by the engagement of side 124 with the surface of an associated newspaper which thus exerts a clockwise force on the upstream end of the side 124. Also in FIG. 7, side 126 and corner 130 have been rotated counter-clockwise to the position previously held by side 124 and corner 134 in FIG. 5 preparatory for engagement by the next newspaper in the stream. The process of FIGS. 5–7 is continuously repeated thereby causing a pulse from transducer 70 for each paper passing by the sensing device. In practical application, operation of the sensing device and rotation of the sensing member is very fast since, as noted above, modern printing presses deliver at an average rate of over 20 papers per second and due to misalignment of individual papers in the stream, the instantaneous rate between individual papers does exceed 100 per second.

In the operation of the device schematically shown in FIGS. 5–7, rotation of sensing member 66 transfers support of sensing device body 64 from contact between side 128 and one newspaper to contact between side 124 and the next adjacent newspaper passing along stream C. This action continues as the stream moves along processing line B to thus achieve incremental rotation of sensing member 64 wherein each increment of rotation occurs at the passing of consecutive newspapers. During each rotation and as viewed in FIGS. 5–7, the axis of rotation of the sensing member, i.e., about pin 120, is first raised by surface 128 against the associated newspaper and then by surface 124 against its associated newspaper. The central axis of the sensing member is moved upwardly in a plane normal to the plane of the work path itself as defined by upper surface 18 of conveyor assembly 10. The mass inertia of sensing device body A about pivot mounting pin 100 when acted upon in one direction by contact with those newspapers being sensed and then in the other direction by torsional spring 106 is small enough to allow the axis of rotation of the sensing member to generally conform to the contour of the individual newspaper articles being sensed. Thus, and due to variations in stream height or thickness as measured from upper surface 18 of the conveyor system and the overall contour of the individual newspapers themselves, sensing device body 64 will be continuously undulating in response thereto about pivot mounting pin 100 to accommodate the overall stream characteristics as defined by the individual newspapers thereof.

The present invention has been found to be particularly effective with and responsive to the various out of order newspaper conditions as schematically shown in FIGS. 1 and 2 to facilitate precise article count. Moreover, the preferred arrangement of the present invention as described above and shown in the drawings allows that the side 124,126 or 128 which is in engagement or resting upon a particular newspaper to follow the contour of the newspaper as the paper moves therepast. This can be extremely important when individual newspapers are extremely thick or when the newspapers have inside sections which are displaced slightly to follow the leading outside sections. In both of these situations, sensing member 66 will be rotated in the same manner hereinabove described for purposes of activating the transducer to maintain a running count of the papers. However, the sensing member will also be moved to some degree in the opposite or clockwise direction in following the contour so that intermediate the leading edges of adjacent papers, i.e., the sensing member will be rotated back to a position intermediate those shown, for example, in FIGS. 6 and 7. Such movement will be insufficient to allow actuating member or vane 68 to affect the sensitive field of transducer 70 which would otherwise cause double pulses from the transducer and provide an inaccurate count of the articles passing along stream C.

Sensing member 66 of the subject invention has been described with reference to a preferred equilateral triangular configuration. The reason that this configuration is deemed preferred is, again, that it provides a favorable torque balance, has small dynamic energy, requires a low operating force, is able to avoid "false" readings or counts at high stream velocities. Further, it allows for maximizing the swing or "throw" of the actuating member or vane between its non-actuating position as shown in FIGS. 5 and 7 and its actuating position as generally shown in FIG. 6. Indeed, the preferred configuration for sensing member 66 in the present invention allows rotation or indexing thereof with only 2 oz. of indexing force. However, prior art devices employing sensing wheels have required approximately 6 oz. or more of indexing force. As a result, such prior art devices were not effective or reliable for use as to small or light papers.

As also noted above, other polygonal configurations could also be advantageously employed when practicing the concepts of the subject invention. Alternative configurations such as square, a regular polygon, hexagonal and the like do not, however, provide the same relative length of "throw" which could cause some operational difficulties during incremental movement of the sensing member in response to individual articles passing thereby in engagement therewith. Specifically, the decrease in the amount of activating member "throw" could result in undesirable double energization of the transducer when slightly reversely rotated in following the contour of extremely thick papers or articles or in following papers in which inside sections have become displaced from the outer section. To compensate for this, design changes may have to be incorporated into the activating member or vane. However, for some printed or other articles, such alternative sensing member configurations will be acceptable and advantageous. Moreover, when utilizing alternative sensing member configurations, other types of transducers may be more advantageously employed than the specific transducer 70 described in detail hereinabove.

One further modification which can be made using the inventive concepts of the present invention is to pivotally mount sensing device body 64 to a slightly larger frame member which itself is pivotally mounted adjacent processing line B to a shaft, axle or the like. In this instance, the larger frame serves the same function as rollers 62 as shown in FIGS. 1, 2, 3 and 4. With this alternative arrangement, sensing device A may be arcuately moved about the pivot mounting for both the larger frame and the pivot mounting for sensing device body 64. The operation of the sensing device when used in this type of alternative arrangement is the same as that hereinabove already described in detail.

The invention has been described with reference to the preferred embodiment. Obviously, modifications and alterations will occur to others upon the reading and understanding of this specification. It is my intention to include all such modifications and alterations insofar as they come within the scope of the appended claims or the equivalents thereof.

Having thus described my invention, I now claim:

1. A sensing device for sensing individual ones of a plurality of articles continuously flowing along a predetermined work path from a first toward a second position therealong, said device comprising:

a sensing device body having spaced apart mounting and sensing ends pivotally mounted at said mounting end adjacent said work path with said sensing end extending generally toward said second position, said body being arcuately movable about said pivot mounting through a sensing plane extending generally longitudinally of said work path;

a sensing member rotatably mounted at generally the central axis thereof adjacent said body sensing end for independent rotation in a plane generally parallel to said sensing plane, said sensing member having a polygonal configuration with the outer peripheral surface thereof comprised of a plurality of alternating distinct sides and corners, said sensing member being incrementally rotated by engagement of the consecutive sides and corners thereof with the leading edges of the individual articles as they flow therepast along said work path from said first toward said second position;

activating means disposed adjacent to and having an elongated substantially straight sensing member engaging surface in physical engagement with said sensing member outer peripheral surface, said activating means being movable between an activating position and a non-activating position responsive to incremental rotation of said sensing member; and, a transducer disposed on said sensing body adjacent said activating means and being selectively energized by movement of said activating means between said activating and non-activating positions in response to each increment of rotation of said sensing member.

2. The sensing device as defined in claim 1 further including means for continuously urging said activating means sensing member engaging surface into physical engagement with said sensing member outer peripheral surface wherein said activating means is moved from one of said activating and non-activating positions to the other and then back to said one position in response to incremental rotation of said sensing member and wherein said sensing member engaging surface is first in contact with one of said sides, the adjacent corner and then the next adjacent side.

3. The sensing device as defined in claim 2 wherein said activating means comprises an elongated activating vane having an activating surface spaced from and generally parallel to said engaging surface, said vane being pivotally mounted adjacent one end thereof to said sensing device body intermediate said sensing member and transducer for arcuate movement between said activating and non-activating positions.

4. The sensing device as defined in claim 3 wherein said vane is normally in a non-activating position in engagement with a side of said sensing member outer peripheral surface and is moved to an activating position in close spaced proximity to said transducer as the adjacent corner of said sensing member is moved into contact therewith during each increment of rotation of said sensing member.

5. The sensing device as defined in claim 1 further including means for continuously urging said sensing device body about said pivot mounting toward said work path.

6. The sensing device as defined in claim 1 wherein said sensing plane is disposed generally normal to the plane of said work path.

7. The sensing device as defined in claim 1 wherein said sensing member outer peripheral surface has a triangular configuration and said sensing member engaging surface of said activating means is continuously urged toward engagement therewith, said activating member normally being in a non-activating position with said sensing member engaging surface in engagement with a sensing member side and then being moved to an activating position in operative association with said transducer as the adjacent sensing member corner moves into engagement therewith during incremental rotation of said sensing member.

8. The sensing device as defined in claim 1 wherein said sensing member is constructed from a plastic material having a low coefficient of friction.

9. A device for sensing individual newspapers, magazines and the like articles moving from a first toward a second position along a predetermined work path defining a work path plane, said device comprising:

a sensing device body including a sensing end disposed in operable association with said work path;

a polygonal sensing member rotatably mounted at generally the central axis thereof to said body adjacent said sensing end with the outer peripheral surface of said sensing member comprised of a plurality of alternating distinct straight sides and corners, said sensing member adapted for incremental rotation about said central axis in response to consecutive engagement of said sides and corners by the leading edges of said articles as they flow therepast along said work path from said first toward said second position;

an elongated activating vane pivotally mounted adjacent one end thereof to said body, said vane having an elongated sensing member engaging surface in cooperative engagement with said sensing member outer peripheral surface and movable between activating and non-activating positions in response to incremental rotation of said sensing member; and, transducer means operably disposed adjacent said activating vane and being selectively energized in response to movement of said activating vane between said activating and non-activating positions.

10. The device as defined in claim 9 wherein said sensing member outer peripheral surface has the conformation of an equilateral triangle, said activating vane being moved from one of said activating and non-activating positions to the other of said positions as engagement of said sensing member engaging surface by said sensing member moves from one of said sides to the adjacent of said corners and is moved from said other position back to said one position as engagement thereof by said sensing member moves from said adjacent corner to the next adjacent side during incremental rotation of said sensing member.

11. The device as defined in claim 10 further including means for continuously urging said activating vane, toward engagement with said sensing member.

12. The device as defined in claim 10 wherein said activating vane includes an activating surface spaced from and generally parallel to said engaging surface, said vane being pivotally mounted to said sensing device body intermediate said sensing member and said transducer, said activating surface being closely spaced toward said transducer when moved to said one position in response to incremental rotational movement of said sensing member.

13. The device as defined in claim 9 wherein said sensing device body includes pivotal mounting means for allowing selective arcuate movement of said body and sensing member toward and away from said work path.

14. The device as defined in claim 13 wherein said sensing device body is continuously urged around said pivot mounting toward said work path.

15. The device as defined in claim 10 wherein said sensing member is mounted for rotation in a plane generally normal to said work path and is constructed from a plastic-like material having a low coefficient of friction.

16. A method for sensing individual articles being transported along a work path from a first toward a second position, said method comprising the steps of:

placing a rotatably mounted sensing member having an outer peripheral surface in the conformation of an equilateral triangle having alternating sides and corners in a close spaced relationship with said work path for selective rotation about a sensing member central axis;

allowing consecutive articles flowing along said work path to engage consecutive sides and corners of said sensing member to cause incremental rotation thereof;

positioning a sensing member engaging surface of an activating member in continuous direct physical contact with the outer peripheral surface of said sensing member;

causing said activating member to be arcuately moved about a pivot mounting adjacent an end thereof between activating and non-activating positions in response to incremental rotation of said sensing member in continuous physical contact with said engaging surface; and, selectively energizing a transducer by an activating area on said activating member in response to movement of said activating member between said activating and non-activating positions.

17. The method as defined in claim 16 wherein said step of causing includes moving said activating means from said non-activating position to said activating position as operative engagement of said engaging surface by said sensing member moves from one of said sides to the adjacent corner and then moving said activating means from said activating position back to said non-activating position as engagement of said engaging surface by said sensing member moves from said adjacent corner to the next adjacent side during each increment of sensing member rotation.

* * * * *